US005768909A

United States Patent [19]

Jeong et al.

[11] Patent Number: 5,768,909

[45] Date of Patent: Jun. 23, 1998

[54] DAMPER COVER FOR REFRIGERATORS

[75] Inventors: Bu Gil Jeong; Ik Geum Kim, both of Suwon, Rep. of Korea

[73] Assignee: Samsung Electronics Co., Ltd., Suwon, Rep. of Korea

[21] Appl. No.: 696,518

[22] Filed: Aug. 14, 1996

[30] Foreign Application Priority Data

Nov. 30, 1995 [KR] Rep. of Korea ..... 95-37584 U

[51] Int. Cl.[6] ..... F25D 17/08

[52] U.S. Cl. ..... 62/408; 248/27.1

[58] Field of Search ..... 62/408; 248/27.1, 248/906

[56] References Cited

U.S. PATENT DOCUMENTS

| | | | |
|---|---|---|---|
| 1,999,194 | 4/1935 | Hubbell, Jr. | 248/27.1 |
| 2,315,746 | 4/1943 | Stewart | 248/906 |
| 2,885,691 | 5/1959 | Juergens | 248/27.1 |
| 3,800,113 | 3/1974 | Sheahan | 248/27.1 |
| 4,687,127 | 8/1987 | Pardo et al. | 248/27.1 |
| 4,914,928 | 4/1990 | Fellwock et al. | 62/408 |
| 5,191,774 | 3/1993 | Park | 62/408 |
| 5,410,373 | 4/1995 | Sagues et al. | 248/27.1 |

*Primary Examiner*—William E. Tapolcal

*Attorney, Agent, or Firm*—Burns, Doane, Swecker & Mathis, L.L.P.

[57] ABSTRACT

A refrigerator includes a housing forming an inner compartment. The housing comprises outer and inner shells, with a space formed between those shells filled with foam. cold air delivered to the compartment is distributed by a damper mounted to the inner shell. The damper includes a cover which is secured to the inner shell by a snap-in connection which avoids the need for separate fasteners.

6 Claims, 2 Drawing Sheets

FIG. 2A
(PRIOR ART)
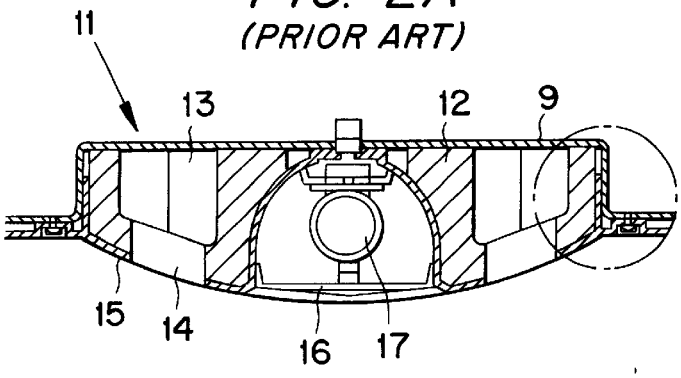
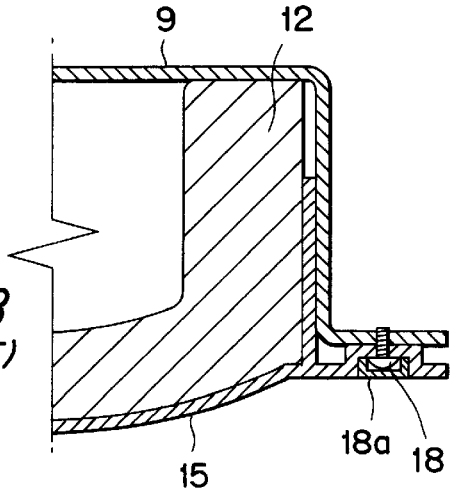
FIG. 2B
(PRIOR ART)
FIG. 3A
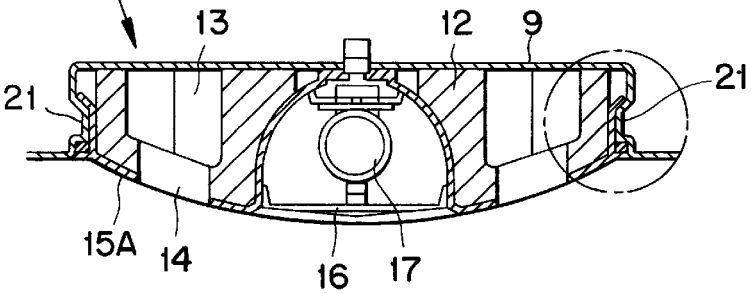
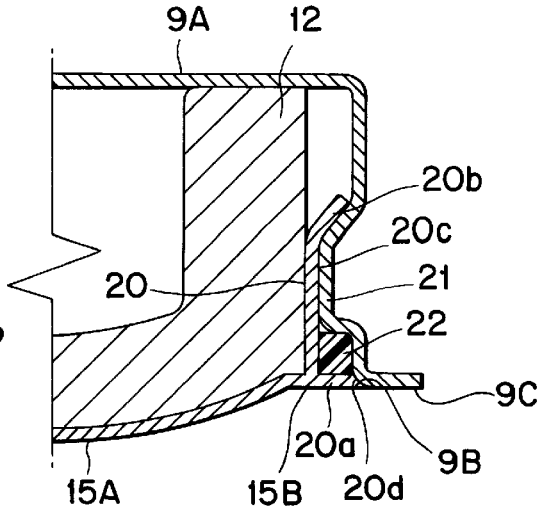
FIG. 3B

DAMPER COVER FOR REFRIGERATORS

BACKGROUND OF THE INVENTION

1. Field of the Invention

The present invention relates, in general, to a structure for mounting a damper cover in refrigerators.

2. Description of the Prior Art

As is well known to those skilled in the art, the housing of a refrigerator comprises an outer case and inner panel which are arranged with a gap therebetween. The gap between the case and panel is filled with an insulating material formed of, for example, a polyurethane foam. The construction of a typical refrigerator is shown in FIG. 1. As shown in FIG. 1, the interior of the refrigerator is typically partitioned into two compartments, that is, a freezer compartment 1 in the upper section and a refrigerating compartment 2 in the lower section, by a partition horizontally extending between the two compartments of the refrigerator. In each compartment 1 or 2, the inner panel forms an inner shell or cabinet 9.

A compressor 4 is installed inside the refrigerator housing under the refrigerating compartment, while an evaporator 5 is installed in the partition. The evaporator 5 receives heat from the air inside the refrigerator in order to generate cold air. In order to distribute the cold air of the evaporator 5 into the two compartments 1 and 2, the refrigerator also includes an air blowing member 6. The air blowing member 6, for example, a fan forcibly blows the cold air, thus causing the cold air to pass through an air flow passage 3 prior to being distributed to the compartments 1 and 2.

The cold air, which is distributed into the refrigerating compartment 2 by the blowing member 6, in turn is uniformly distributed to the chambers inside the compartment 2 by a damper unit 10. The damper unit 10 is typically mounted to the rear wall of the inner cabinet 9 in the refrigerating compartment 2.

FIG. 2A, 2B shows the construction of the above damper unit 10 with a typical structure for mounting a damper cover to the inner cabinet or shell 9. As shown in FIG. 2A, the damper unit 10 typically includes a spacer damper 12 which guides the cold air. The damper unit 10 also includes an air flow passage 13 which the cold air flows through. The unit 10 further includes the damper cover 15 which is provided with cold air outlets 14. The cold air is discharged from the damper unit 10 through the outlets 14 and is thereby uniformly distributed to the chambers inside the refrigerating compartment 2.

In FIG. 2A, the reference numerals 16 and 17 denote a lamp and lamp cover, respectively, installed in the damper unit 10.

Several types of structures for mounting the damper unit to the inner cabinet in the refrigerating compartment have been proposed as disclosed in U.S. Pat. Nos. 4,914,928 and 5,191,774. The damper unit 10, which is based in the damper cover 15, may be mounted to the rear wall of the inner cabinet 9 in the refrigerating compartment 2 by means of a plurality connecting members, such as set screws 18, as shown in FIG. 2.

However, the above structure for mounting the damper cover to the cabinet 9 using the screws 18 has a problem in that the screws 18 must be tightened one by one to mount the damper cover to the cabinet 9, thus complicating the process for producing the refrigerators. In addition, the screws 18 are covered by the respective screw covers 18*a* in order to improve the appearance inside the refrigerator. However, the use of screw covers 18*a* increases the cost of the refrigerators and complicates the process for producing the refrigerators.

SUMMARY OF THE INVENTION

It is, therefore, an objective of the present invention to provide a structure for mounting a damper cover to the inner cabinet of the refrigerating compartment of a refrigerator without using any connecting members such as screws, thus reducing the cost of the refrigerators and simplifying the process for producing the refrigerators, and thereby improving productivity.

In order to accomplish the above objective, the present invention provides a structure for mounting a damper cover to an inner cabinet in a refrigerator, comprising a fitting provided in each side edge of the damper cover and a fitting protrusion formed by partially protruding the inner cabinet at a position corresponding to the fitting and snapped into the fitting to mount the damper cover to the inner cabinet. The fitting includes a front wall extending horizontally from a side of the damper cover at a predetermined width. A fitting wall extends backward from the side of the damper cover and in turn is gently bent outwardly in the rear portion thereof. The fitting wall cooperates with the front wall to form a fitting channel. The inner cabinet includes a protrusion which is received in the channel to form a snap-in connection therewith.

The outer edge of the front wall of the fitting is brought into contact with a corner of the inner cabinet. The above edge and corner are rounded with a given radius of curvature and thereby maximize the contact area between them and allow the front wall and cabinet to be arranged in the same plane.

BRIEF DESCRIPTION OF THE DRAWINGS

The above and other objectives, features and other advantages of the present invention will be more clearly understood from the following detailed description taken in conjunction with the accompanying drawings, in which:

FIG. 2A is a sectional view showing the construction of a conventional damper unit with a typical damper cover mounting structure;

FIG. 2B is an enlarged fragmentary view of FIG. 2A;

FIG. 3A is a sectional view showing the construction of a damper unit with a damper cover mounting structure in accordance with a preferred embodiment of the present invention; and FIG. 3B is an enlarged fragmentary view of FIG. 3A.

DESCRIPTION OF A PREFERRED EMBODIMENT

Figure 1:
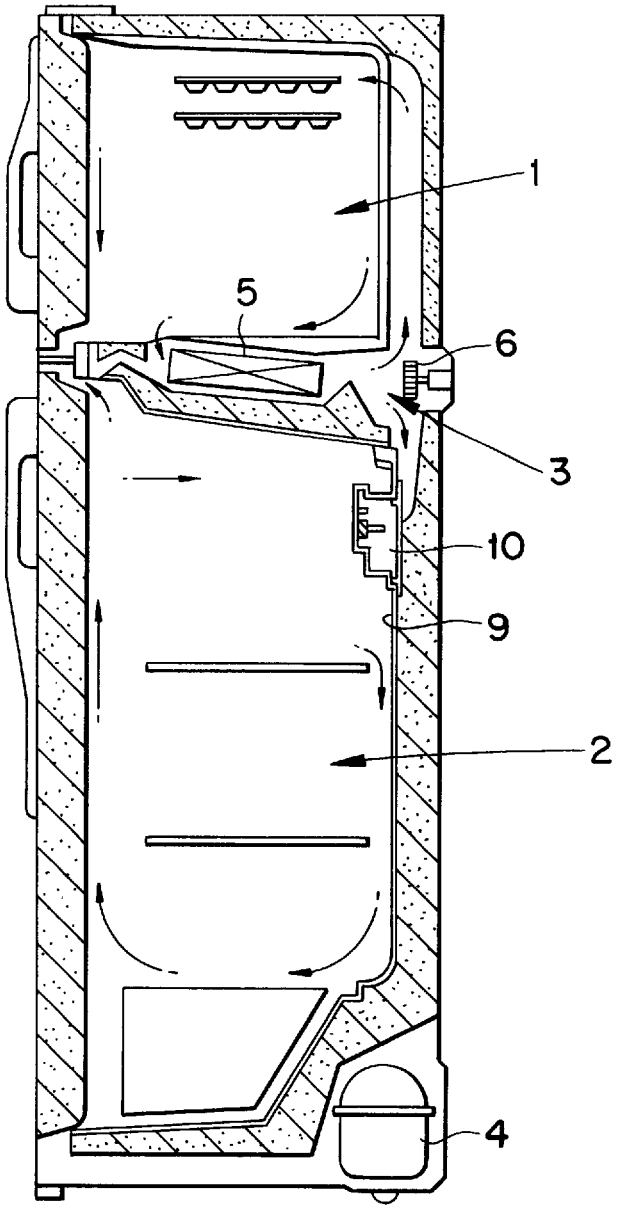
FIG. 1 (PRIOR ART)
FIG. 1 is a sectional view showing the construction of a conventional refrigerator.

Most of the elements of the preferred embodiment of this invention are common with those of the prior embodiment of FIGS. 1 and 2A–2B. The elements common to both the embodiment of this invention and the prior embodiment will thus carry the same reference numerals and description thereof is omitted.

FIG. 3A–3B shows a damper cover mounting structure in accordance with the preferred embodiment of the present invention. As shown in FIG. 3, a simple mounting structure of this invention mounts the damper cover 15A to the rear wall of the inner cabinet 9A in the refrigerating compartment 2 without using any connecting members such as set screws.

As shown in FIG. 3B, the damper cover mounting structure of this invention comprises a fitting 20 which is provided at each side edge of the damper cover 15 by casting both the cover body and the fitting 20 as a single structure. The above fitting 20 includes two walls, that is, a front facing wall 20*a* and side fitting wall 20*b* which extend laterally and rearwardly, respectively from each side edge of the cover body. The front facing wall 20*a* extends horizontally from each side edge of the cover body to a predetermined width and is rounded inwardly concavely on its rear edge 20*d* with a given radius of curvature. The side fitting wall 20*b* extends backward from each side edge of the cover body and is slightly bent outwardly at the rear portion thereof. The fitting 20 thus has a generally U-shaped cross-section with a fitting channel 20*c* defined by the two walls 20*a* and 20*b*. The inner cabinet 9A. includes two fitting protrusions 21 which are received in respective fittings 20C of the damper cover 15 and thereby mount the damper cover 15 to the inner cabinet 9A. Each fitting protrusion 21 protrudes from the inner cabinet 9A at a position corresponding to an associated fitting 20 of the damper cover 15.

A corner 9B of the inner cabinet 9A mates with the rounded edge 20*d* of each wall 20*a* and is rounded in order to substantially conform to the rounded edge 20*d*. Due to the above rounded configuration of the edge 20*d* and corner 9B, the contact area between the wall 20*a* and the cabinet 9A is maximized. In addition, the outer surface 15B of each wall 20*a* of the damper cover 15 is arranged in the same plane as the outer surface 9C of the cabinet 9A, thus providing a good internal appearance in the refrigerating compartment 2.

A space is formed between the front wall 20*a* of the cover 15 and the fitting protrusion 21 of the cabinet 9A and that space is densely filled up with a cushion 22 formed of polystyrene foam. The above cushion 22 not only remains no space in entire junction between the damper cover 15 and the cabinet 9A, it also prevents leakage of the cold air through the junction.

The operational effect of the above mounting structure will be described hereinbelow.

In order to mount the damper cover 15 to the inner cabinet 9A in the refrigerating compartment 2, the damper cover 15 is pushed onto the inner cabinet 9A with the cushions 22 occupying the spaces between the walls 20*a* and the protrusions 21. The side fitting walls 20*b* of the cover 15 are elastically bent inward until they completely pass by the respective fitting protrusions 21. When the side fitting walls 20*a* have passed by the respective protrusions 21, the protrusions 21 snap into the fittings 20. That is, when the fitting wall 20*a* has passed by the protrusion 21, the fitting wall 20*a* elastically returns to its original position due to its restoring force and allows the protrusion 21 to be tightly seated in the fitting channel 20*c*,thereby forming a snap fitting therewith. The damper cover 15 is thus tightly mounted to the inner cabinet 9A.

In the above state, the front walls 20*a* and the cabinet 9A form the same plane, thus naturally providing a good internal appearance to the refrigerating compartment 2.

Due to the above cushions 22, the damper cover 15 is stably mounted to the cabinet 9A and is free from cold air leakage through the junction between the cabinet 9A and cover 15.

As described above, the present invention provides an improved structure for mounting the damper cover to the inner cabinet in the refrigerating compartment of a refrigerator. The mounting structure of this invention simply and tightly mounts the damper cover to the inner cabinet without using any connecting members such as screws. The mounting structure thus simplifies the process for producing the refrigerators, thus reducing the cost of the refrigerators and improving productivity.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A refrigerator comprising:

a housing including an inner compartment lined by an inner shell of the housing;

a damper mounted to the inner shell for distributing cold air within the compartment, the damper including a cover mounted directly to the inner shell, the cover including a pair of side portions, each side portion including a laterally outwardly extending wall and a rearwardly extending wall, the rearwardly extending wall being bent laterally outwardly to form, together with the laterally outwardly extending wall a channel;

the shell including protrusions fitting into respective ones of the channels to form therewith a snap fitting for securing the cover to the inner shell;

both of the laterally outwardly extending walls including an outer edge abutting against a portion of the inner shell, an interface between the outer edge and the portion of the inner shell being of concave/convex shape, a forwardly facing surface of each of the laterally outwardly extending walls being substantially coplanar with a forwardly facing surface of the inner shell.

2. The refrigerator according to claim 1 wherein the outer edge is of concave shape and the portion of the inner shell being of corresponding convex shape.

3. The refrigerator according to claim 1 further including a flexible cushion disposed in each channel between the laterally outwardly extending wall and the protrusion.

4. The refrigerator according to claim 3 wherein the cushion comprises a polystyrene foam.

5. The refrigerator according to claim 1 wherein each of the laterally outwardly extending walls is flat.

6. The refrigerator according to claim 1 wherein the outer edge of each laterally outwardly extending wall is of concave shape, and the portion of the inner shell is of convex shape.

* * * * *